US005352346A

United States Patent [19]

Rodriguez

[11] Patent Number: 5,352,346

[45] Date of Patent: Oct. 4, 1994

[54] CURRENT GENERATION AND CONTROL SYSTEMS FOR ELECTROLYTIC VAT

[75] Inventor: Dionisio Rodriguez, Pamplona, Spain

[73] Assignee: Novamax Technologies Holdings, Inc., Ontario, Canada

[21] Appl. No.: 952,547

[22] PCT Filed: Dec. 20, 1991

[86] PCT No.: PCT/ES91/00089

§ 371 Date: Feb. 11, 1993

§ 102(e) Date: Feb. 11, 1993

[87] PCT Pub. No.: WO92/18666

PCT Pub. Date: Oct. 29, 1992

[30] Foreign Application Priority Data

Apr. 11, 1991 [ES] Spain ..... P 9100924

[51] Int. Cl.[5] ..... C25B 9/04; C25B 15/02; C25D 21/12

[52] U.S. Cl. ..... 204/228

[58] Field of Search ..... 204/228

[56] References Cited

U.S. PATENT DOCUMENTS

| | | | |
|---|---|---|---|
| 2,471,912 | 5/1949 | Stolz | 204/211 |
| 4,152,221 | 5/1979 | Schaedel | 205/108 |
| 4,170,739 | 10/1979 | Frusztajer et al. | 307/2 |
| 4,338,176 | 7/1982 | Pelaez | 204/228 |
| 4,666,567 | 5/1987 | Loch | 204/228 X |
| 4,839,002 | 6/1989 | Pernick et al. | 204/228 X |
| 5,102,513 | 4/1992 | Pelkus | 204/228 X |

FOREIGN PATENT DOCUMENTS

| | | |
|---|---|---|
| 7630499 | 10/1976 | France . |
| 501735 | 1/1971 | Switzerland . |

*Primary Examiner*—Donald R. Valentine
*Attorney, Agent, or Firm*—Helfgott & Karas

[57] ABSTRACT

A current generation and control system for electrolytic processes in an electrolytic vat in which two autotransformers are provided each having a primary part coupled to a regulator for adjusting the number of coils and driven by control from a microprocessor and a secondary part coupled to a respective input terminal of the electrolytic vat and to a respective half-wave rectifier also controlled by the microprocessor wherein the two rectifiers including thyristors are coupled between the autotransformers and the respective input terminals in counter position to suppress the negative and positive half-waves of the voltages generated by the autotransformers.

2 Claims, 15 Drawing Sheets

CURRENT GENERATION AND CONTROL SYSTEMS FOR ELECTROLYTIC VAT

OBJECT OF THE INVENTION

The present invention relates to a number of improvements to current control systems used in electrolytic processes such as the conventional electrolytic coloration processes, opacification processes, processes for obtaining a range of greys, and aluminum optical interference coloration processes, though clearly such improvements can also be applied to any other field requiring like current control systems.

BACKGROUND OF THE INVENTION

For aluminium electrolytic coloration processes to be carried out to full satisfaction, a very thorough control on the current applied must exist.

Thus, for instance, Spanish patent of invention no. 498,578 and its U.S. Pat. No. 4,421,610, sets forth an electrolytic coloration process for an aluminium or aluminium alloy element, consisting of a first phase where, inter alia, an alternating current with a peak voltage lying between 25 and 85 volts and a current density below 0.3 amps. per square decimeter must be applied.

More specifically, and in order to obtain such alternating current, a polyphasic network or the secondaries in a polyphasic network transformer are used conducting the positive and negative half-cycles with the same conduction angle and both variables as required, which conduction angles are in turn controlled by reverse shunt thyristors or by triacs.

Said control of the thyristors' conduction angle obviously allows the average voltage to be controlled, but not so the peak voltage, and therefore the results attained, though acceptable, cannot be deemed to be the most favourable.

Manifold solutions have been put forward so far as electrolytic coloration processes are concerned, and the essential problem common to all is the difficulty of suitably controlling the currents applied to the vat.

Furthermore, from the theoretical viewpoint , opacification processes are known to attain, likewise by electrolytic processes, a transformation of the anodic film rendering the same opaque, but such processes require very low voltages in practice, less than three volts, and moreover very specific values, and no current control means exists presently that may allow the same to be maintained within the limits the process requires.

Optical interference aluminum coloration processes are also known, where the above-mentioned problem is even worse, for within a given range of voltages, minor variations in the value of the voltage lead to significant changes in the colour obtained, for which reason this system has not been developed industrially either, for the different load characteristics and the actual installation determine variations in the voltage drop and, hence, variations in the voltage applied to the load, originating undesirable colour changes.

There is hence no doubt whatsoever that the fact that there are presently no suitable means for controlling the current applied to electrolytic processes significantly constrains progress in this field.

In order to grasp the difficulties of the different aluminum electrolytic coloration systems it is worthwhile to note some of the phenomena that take place when applying an alternating current to the previously anodized aluminum:

During the positive half-cycle there is no deposition whatsoever at the anodic film pores. In the event of the voltage applied allowing passage of current, oxidation takes place, leading to an increase in film barrier thickness. The final film barrier thickness is proportional to the peak voltage applied.

During the negative half-cycle there is a double deposition. On the other hand, deposition of the metallic cation present in the form of a metallic particle. For instance:

$$Sn^2+2e^-—Sn$$

Furthermore, deposition of protons present in the electrolyte, that become atomic hydrogen:

$$H^++1e^-—H$$

The speed of migration of the protons toward the bottom of the pores depends upon the voltage applied and the density of the circulating current. This latter in turn depends upon the total circuit impedance (see electric model of the U.S. Pat. No. 4,421,602, namely FIG. 1 thereof).

Because of the semiconducting nature of the film barrier, atomic hydrogen can be formed at low voltages, for instance at roughly 2 to 4 V. As higher voltages are applied and current circulation rises, this hydrogen can act differently:

$$GH+Al_2O_3—2Al^{3+}+3H_2O \quad a)$$

$$H+Sn^{2+}—Sn+2H^+ \quad b)$$

$$H+H—H_2 \quad c)$$

Reaction a) takes place at voltages under 7–8 V.

Reactions b) and c) take place at voltages in excess of 8 V.

When the kinetic energy of the protons is very high, or film barrier resistance is weak, the protons can cross the film barrier and reaction c) can take place at the metal-oxide interface. In such event, the pressure generated by the accumulation of the molecular hydrogen formed can cause spalling.

These three types of effects caused by hydrogen can be regulated by accurately controlling the voltage applied during the negative half-cycle. The voltage in the positive half-cycle must be adjusted simultaneously to keep the circuit's impedance under control.

Thus:

With a), the bottom of the pores can be modified to cause the film barrier to become opaque, or the film barrier diameter and thickness adjusted in order to subsequently obtain the optical interference colours.

With b), the formation of metallic particles at the bottom of the pores can be enhanced; cations, for instance $Sn^{2+}$.

Effect c) can be regulated by the separate positive half-cycle voltage control, that allows film barrier thickness to be increased, thereby to increase resistance and prevent spalling.

By analyzing these three effects, it can be clearly inferred that it is necessary to regulate and control the positive and negative half-cycle voltages and currents separately.

In electrolytic coloration processes, the passage of current is usually controlled and regulated indirectly by adjusting and controlling the voltage applied to the electric circuit (see FIG. 1 in U.S. Pat. No. 4,421,610). This adjustment is made through programs that linearly modify the voltage according to time.

The voltage must be modified as circuit impedance changes. If circuit impedance variation is not linear, neither can voltage variation be so. Thus, certain mathematical algorithms similar to those relating circuit impedance variations during the process must be applied at the voltage adjustment programs.

DESCRIPTION OF THE INVENTION

The improvements to the current control systems subject hereof fully solve the aforesaid problems, allowing the voltage applied to be accurately adjusted at all times to meet requirements under the theoretical process being put in practice.

More specifically, and in order to achieve the above, such improvements comprise two shunted autotransformers, each such autotransformer being provided with a duly controlled half-wave rectifier, thereby to take the positive half-wave of the resulting voltage from one of the autotransformers, and the negative half-wave from the other autotransformer.

Both these autotransformers, theoretically in step, may in practice undergo phase displacement leading to short circuit problems, to which end it has been foreseen, as another characteristics of the invention, that the conduction angle of the thyristors provided in the aforesaid rectifiers be cut for safety, specifically affecting the positive and/or negative half-waves near the phase reversal area, where those short circuit problems deriving from a possible displacement of either phase can originate.

To supplement the said structure, and as yet another characteristic of the invention, the current control system is provided with a microprocessor, carrying, as appropriate, an operative program suitable for the process to be carried out by mathematical algorithms, which microprocessor will "read" the voltage being applied to the load at all times through sensors duly established at the input to the vat, and that, when the latter moves away from the established pattern, shall act upon the control means of the autotransformers and the half-wave rectifiers, to achieve the pertinent modifications in such elements in order to achieve an almost exact precision in the voltage or current applied to the load.

DESCRIPTION OF THE DRAWINGS

In order to provide a fuller description and contribute to the complete understanding of the characteristics of this invention, a set of drawings is attached to the specification which, while purely illustrative and not fully comprehensive, shows the following.

PREFERRED EMBODIMENT OF THE INVENTION

Figures 1, 1A:
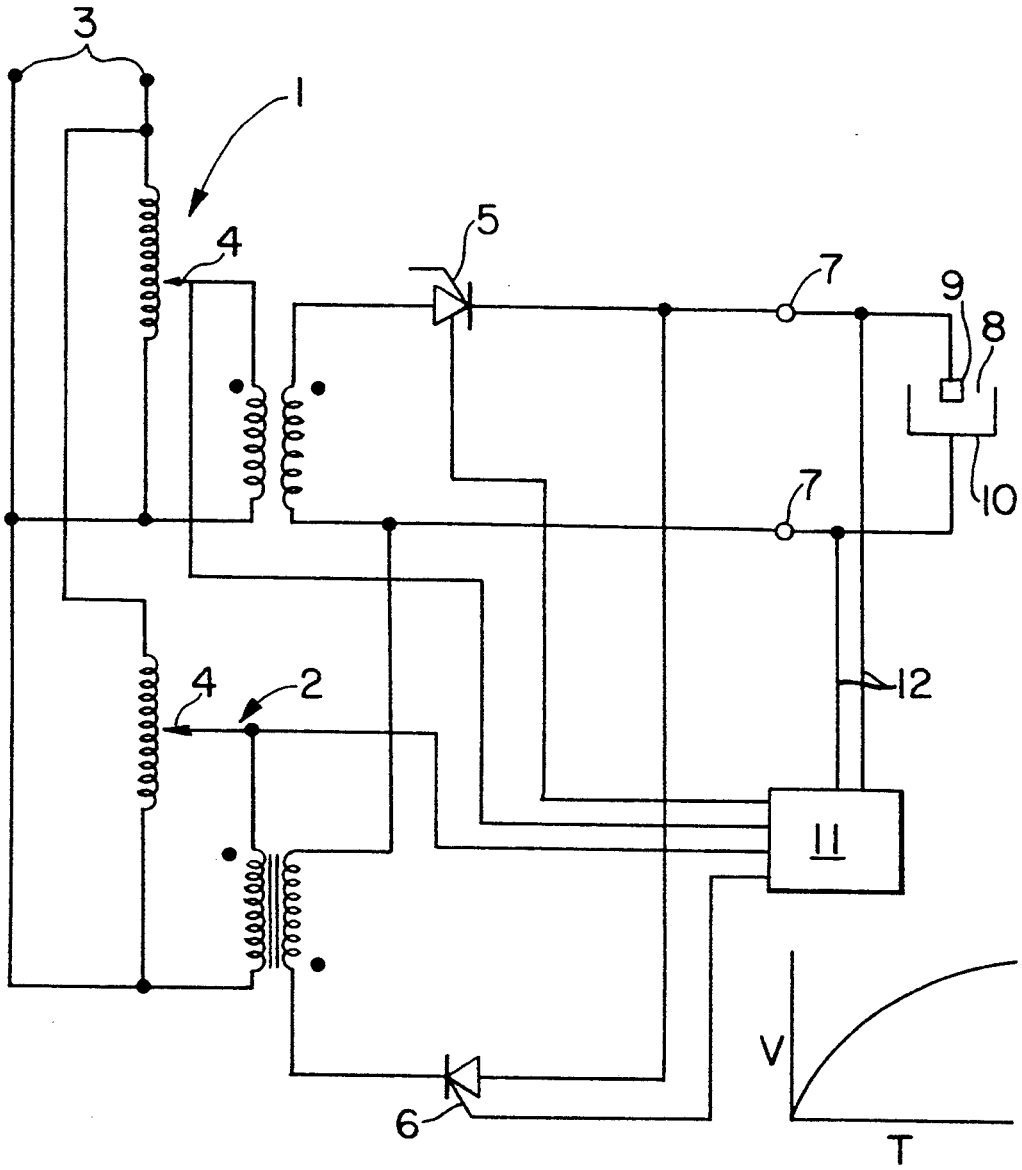
FIG. 1. Is a diagram showing the current control system for electrolytic processes, with the improvements subject hereof.

In light of the above figures, and more specifically FIG. 1, it can be observed that the improvements to the current control systems subject of the invention comprise the use of two autotransformers (1) and (2) shunted to a given phase (3) of the mains, the primary of such autotransformers being provided with a regulator (4), of any conventional sort, driven automatically to allow the number of coils that are effective from the viewpoint of transformation to be varied, while the secondary of such transformers (1) and (2) is fitted with two half-wave rectifiers (5) and (6) situated in counterposition, so that while the rectifier (5) suppresses the negative half-wave of the current generated by the autotransformer (1), the rectifier (6) suppresses the positive half-wave of the current generated by the autotransformer (2), such autotransformers being, as aforesaid and beyond the half-wave rectifiers, shunted to the terminals (7) representing the input or connection to the electrolytic vat (8), one of the terminals being connected to the load (9) and the other to a counterelectrode (10).

A microprocessor (11) permanently controls the voltage at the input (7) to the vat (8) through the connection (12) detecting contingent drifts of such voltage or current in either direction with regard to the theoretical value foreseen, so that, with a suitable program, using the mathematical algorithms, it shall act on the autotransformers' (1) and (2) regulators (4), and on the rectifiers (5) and (6), to reset such theoretical and hence most ideal value.

Figure 2:
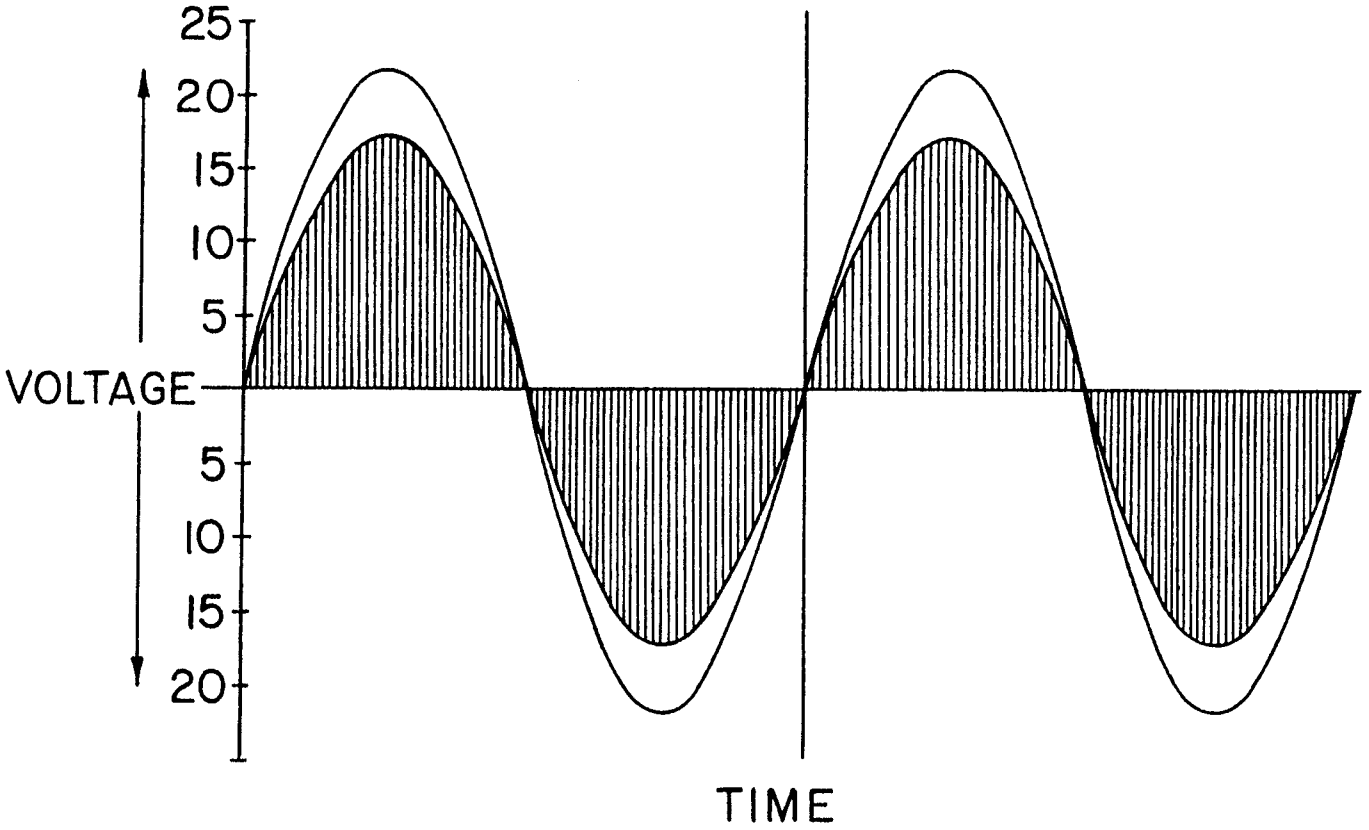
FIG. 2. Is a voltage time diagram for one of the system autotransformers, showing possible voltage value variations.
Figure 3:
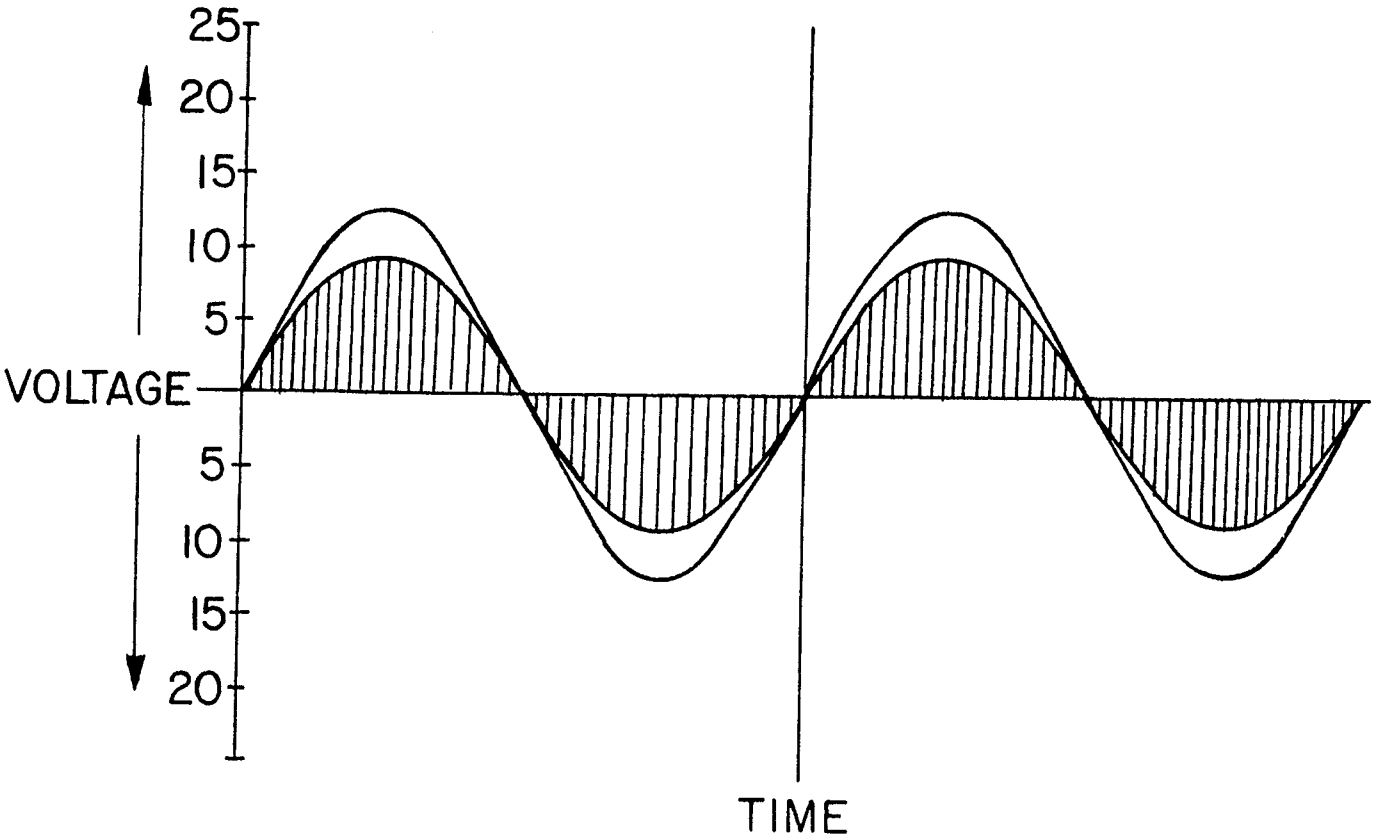
FIG. 3. Is the same diagram as in FIG. 2, but for the second autotransformer.

According to this structure and as aforesaid, a symmetric sine wave of variable value as shown in FIG. 2 will be obtained at the autotransformer (1) output, adjustable at will through the said regulator (4), as is the case of the autotransformer (2), that will provide an output symmetric sine wave signal as shown in FIG. 3.

Figure 4:
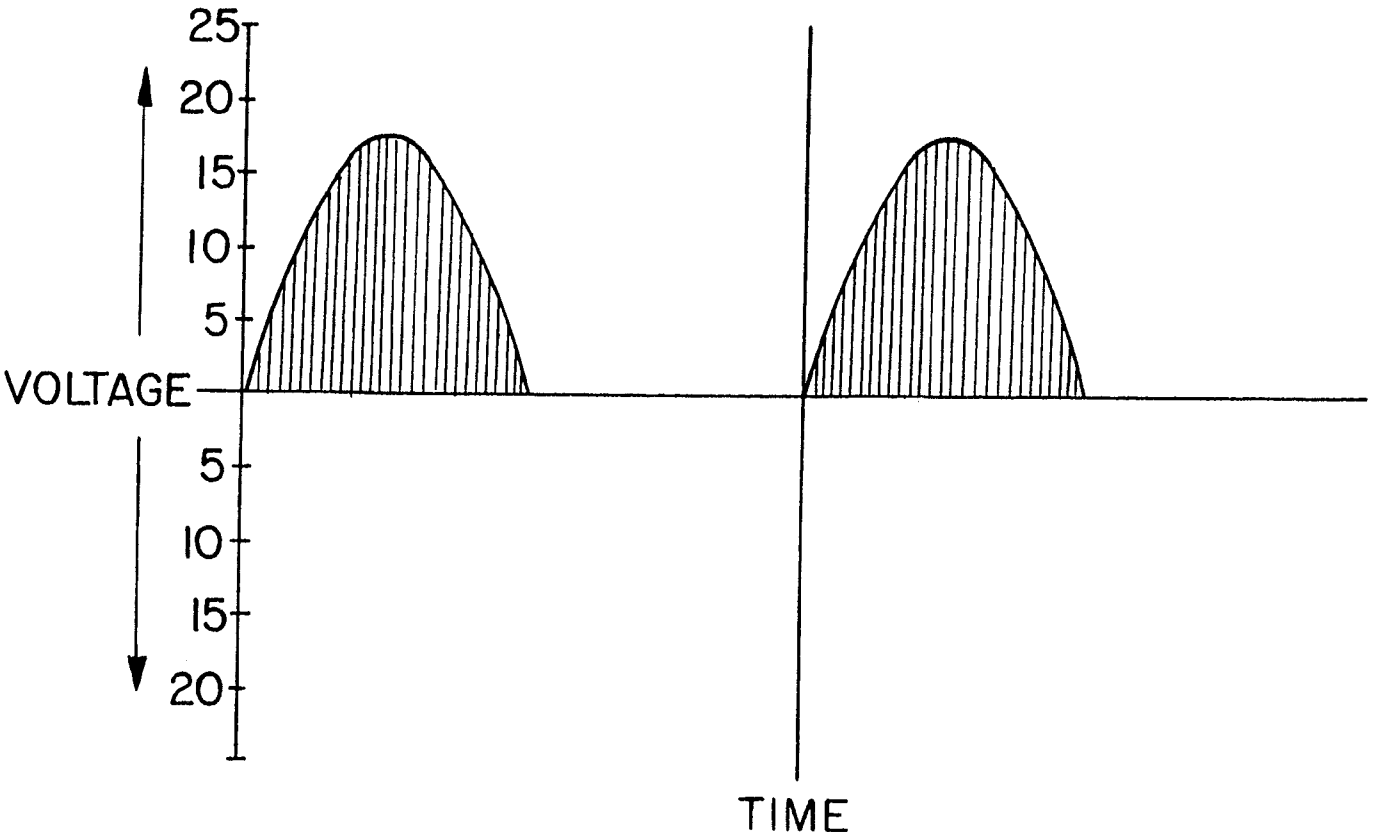
FIG. 4. Is the voltage diagram for the first autotransformer after passage through the first half-wave rectifier.
Figure 5:
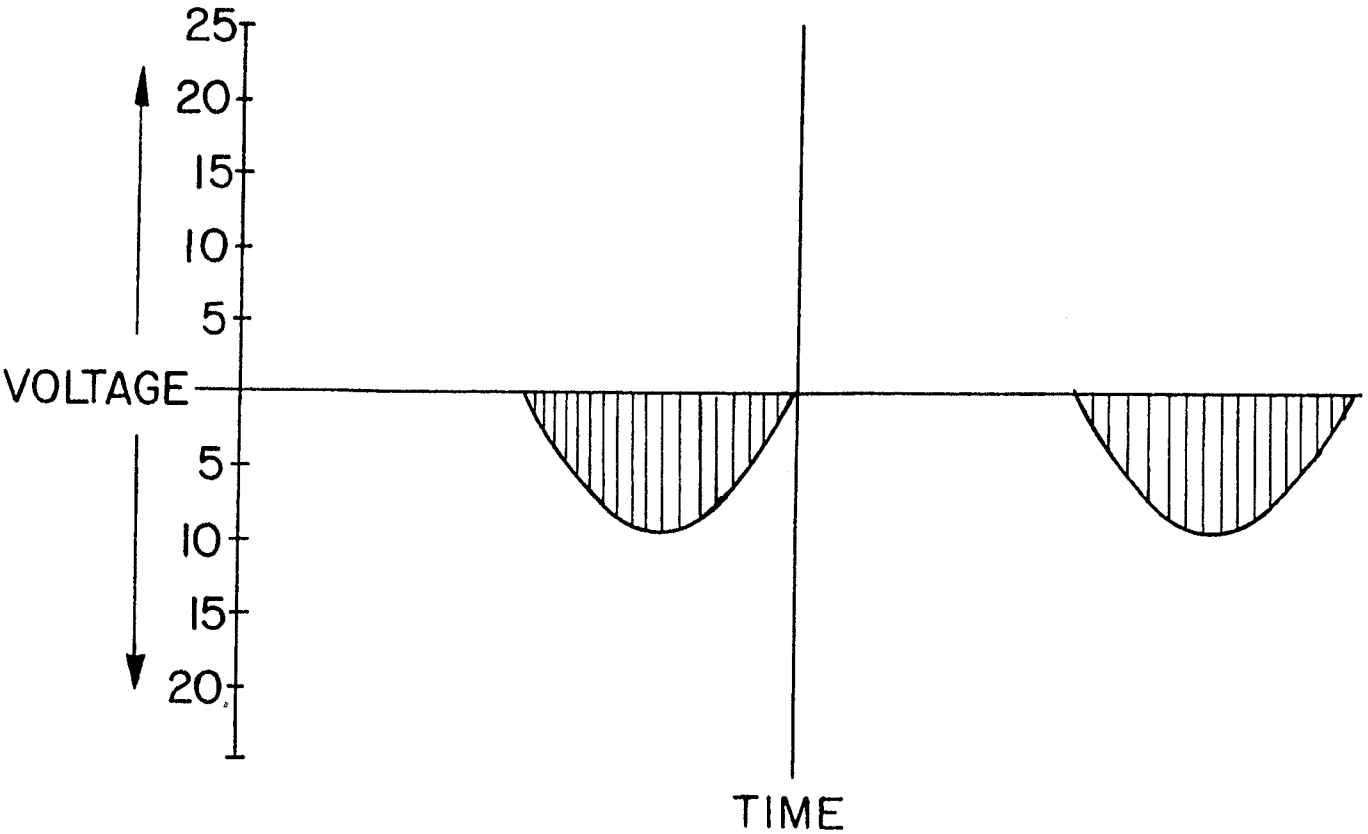
FIG. 5. Is the same diagram as in FIG. 4, but for the second autotransformer.
Figure 6:
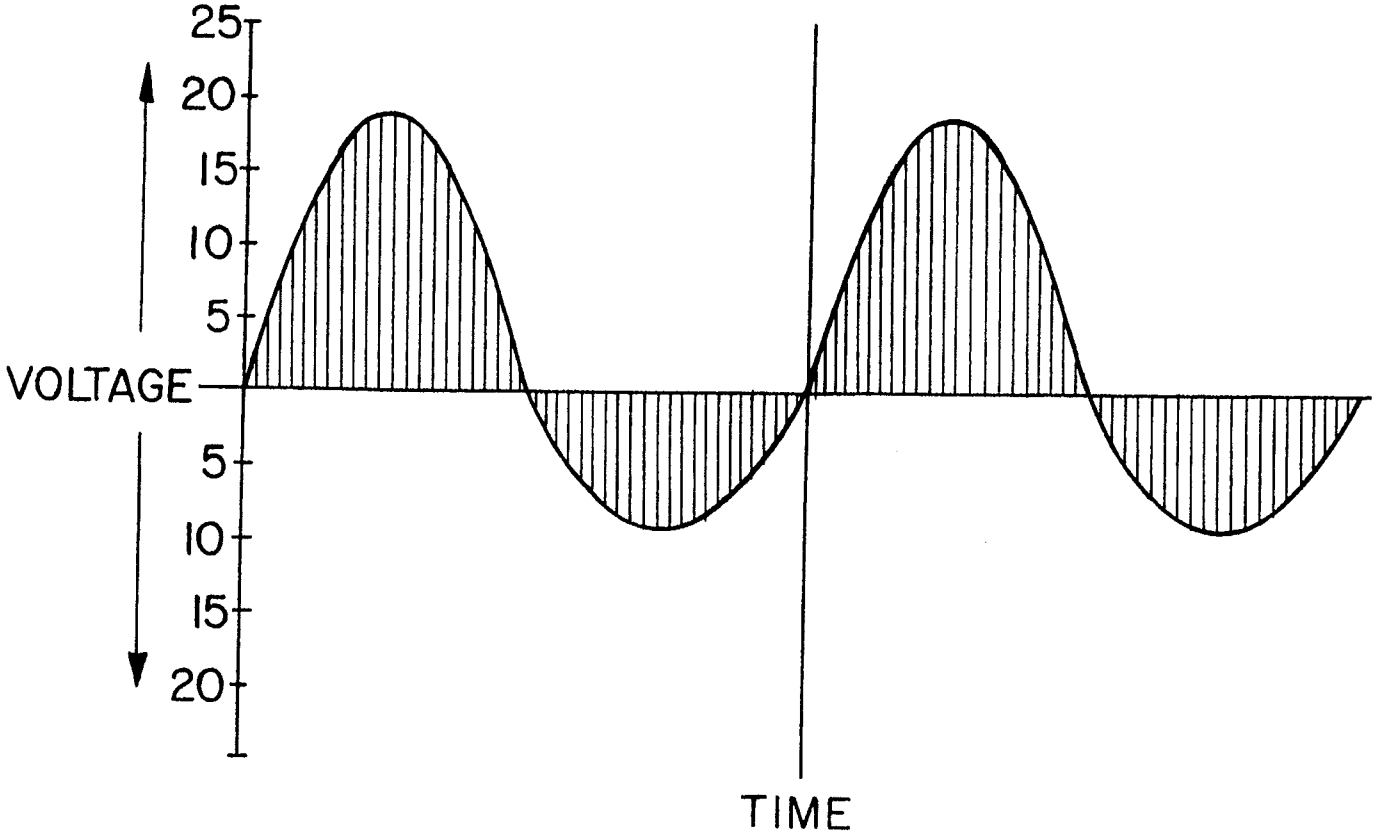
FIG. 6. Is the same diagram as in the previous figures, but showing the input to the vat, i.e., the summation of both autotransformers.

The half-wave rectifier (5) will suppress the negative half-waves from the autotransformer (1) output, as shown in FIG. 4, whilst the half-wave rectifier (6) will do the same at the autotransformer (2) output with the positive sine waves, as shown in FIG. 5. As both autotransformers are shunt-fed, an asymmetric sine wave will appear at their common output (7), as shown in FIG. 6, the summation of the voltages that are in turn shown in FIGS. 4 and 5.

Figure 7:
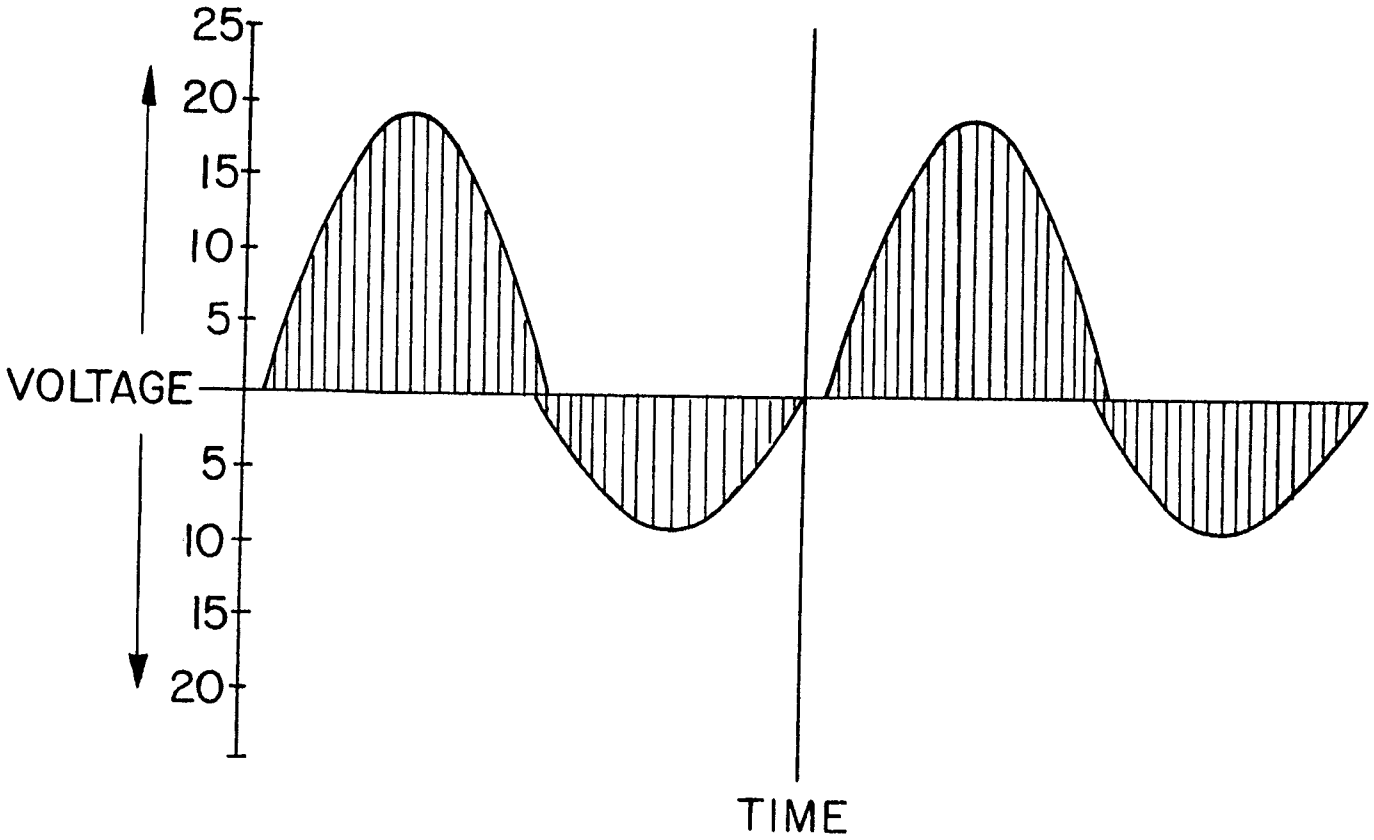
FIG. 7. Is the same diagram as in the previous figure, but with a phase difference between both autotransformers that is possible in practice.
Figure 8:
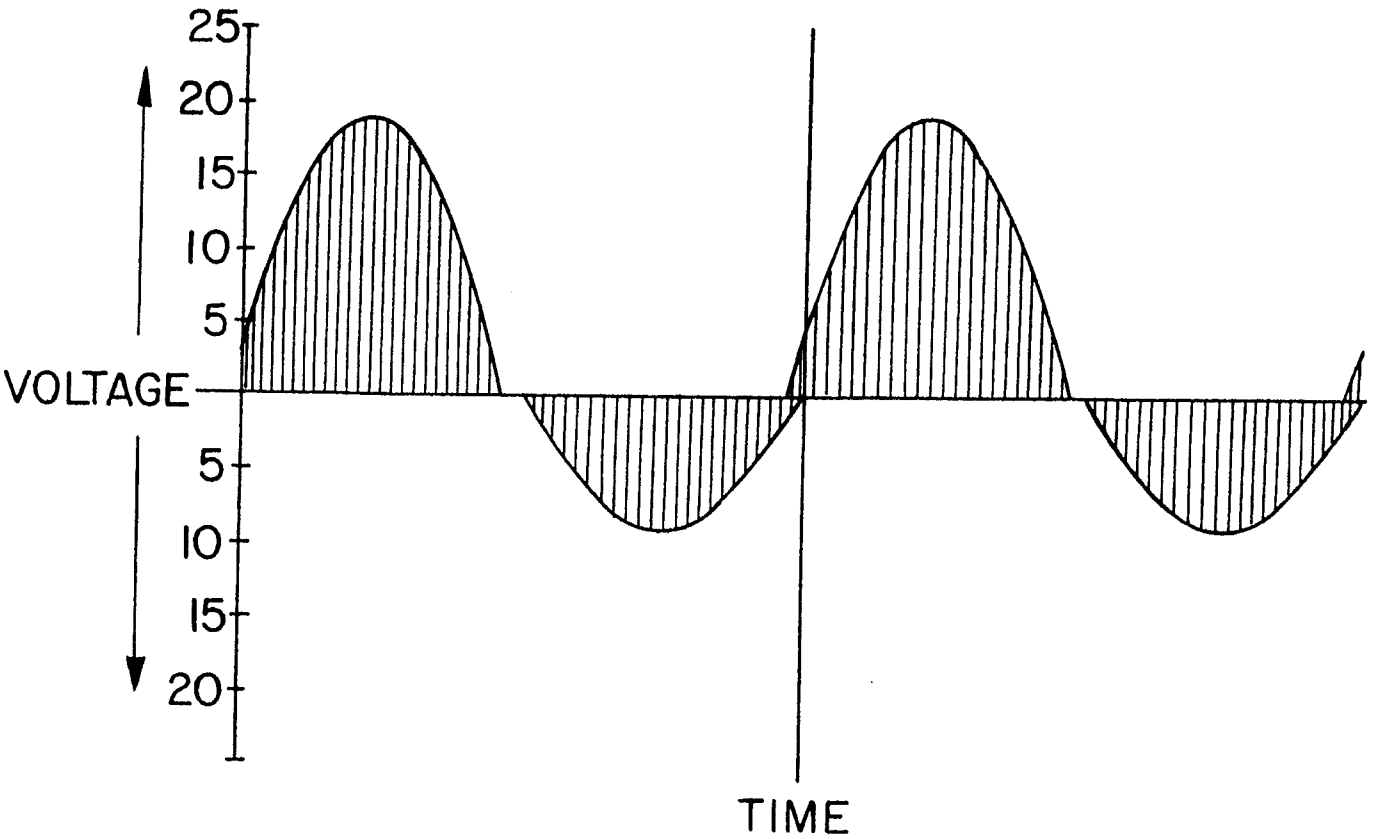
FIG. 8. Is the same diagram as in FIG. 7, with the phase difference in the opposite direction to that of the said figure.
Figure 9:
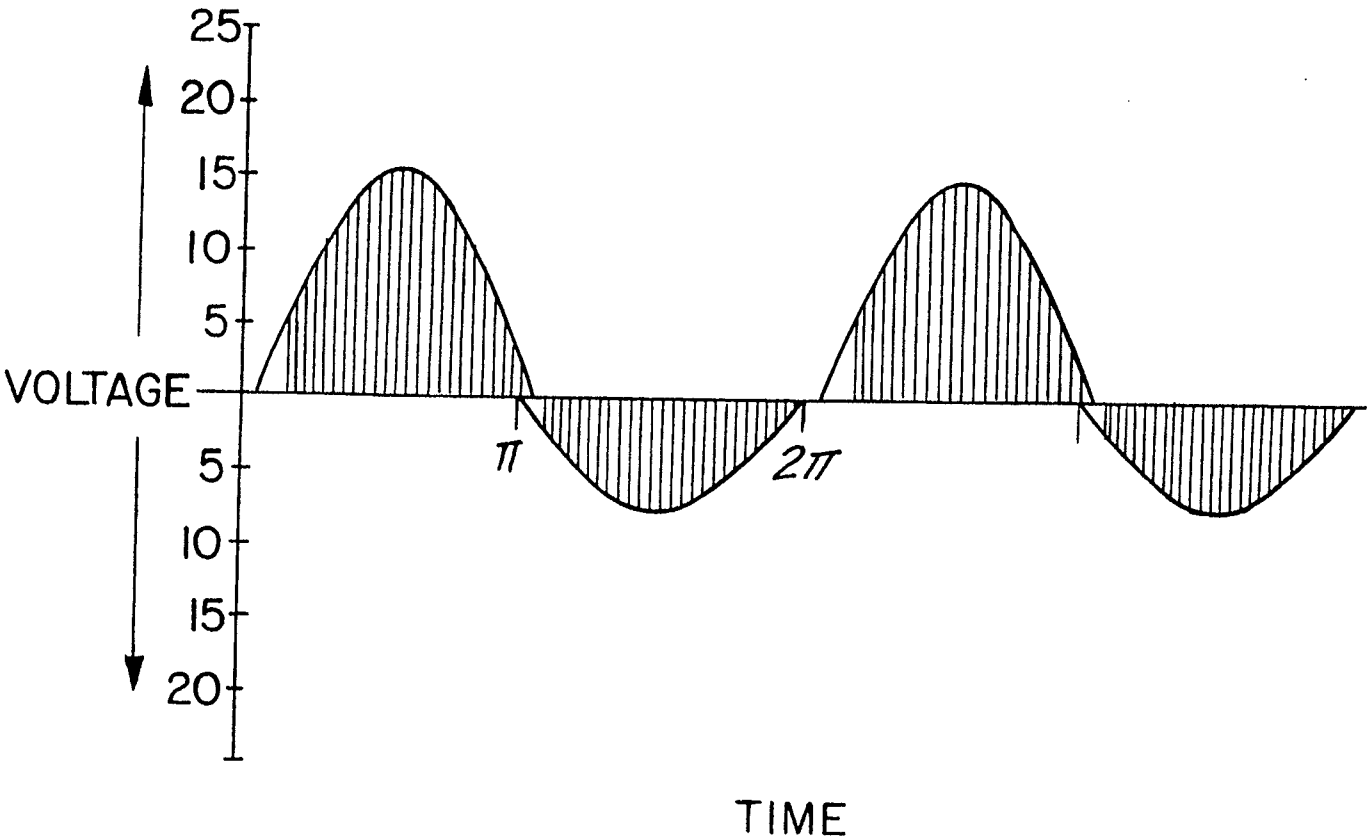
FIG. 9. Is the voltage diagram of FIG. 6 after providing the thyristors' conduction angle with a suitable cut in order to avoid the problems shown in the diagrams of FIGS. 7 and 8.
Figure 10:
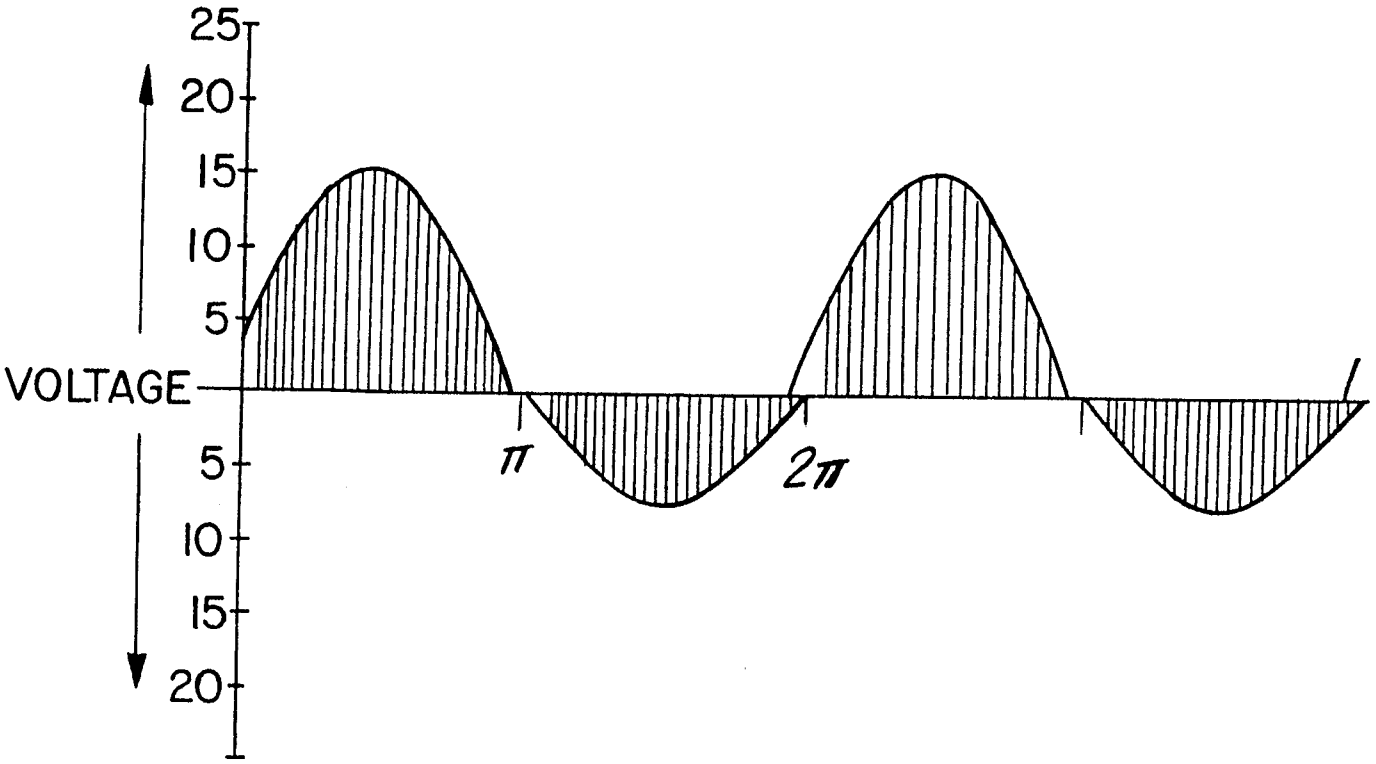
FIG. 10. Is, based upon the voltage waves cut in the previous figure, the phase difference between both autotransformers and the absence of short circuit effects.

In practice and because of problems that have nothing to do with the actual electrolytic installation, there will be phase differences between the voltages generated by both autotransformers, in the direction shown in FIG. 7 or in the opposite direction shown in FIG. 8, and to such end, acting on the thyristors provided in the half-wave rectifiers (5) and (6), both the positive and the negative half-waves are provided with a slight cut at their areas closest to the zero value points for voltage, as shown in FIG. 9, and therefore in the event of a phase difference as aforesaid, such cuts prevent the overlap of voltages in the opposite direction, as is in turn shown in FIG. 10, and the resulting short circuits that would derive from such partial overlaps.

EXAMPLES

Example 1

Bronze electrolytic coloration.

Anodizing phase: The element to be treated was previously anodized in a bath comprising sulphuric acid at a concentration of 180 g/l, at a temperature of 20° C., and under a current density of 1.5 A/dm$^2$ for 35 minutes.

Figure 11:
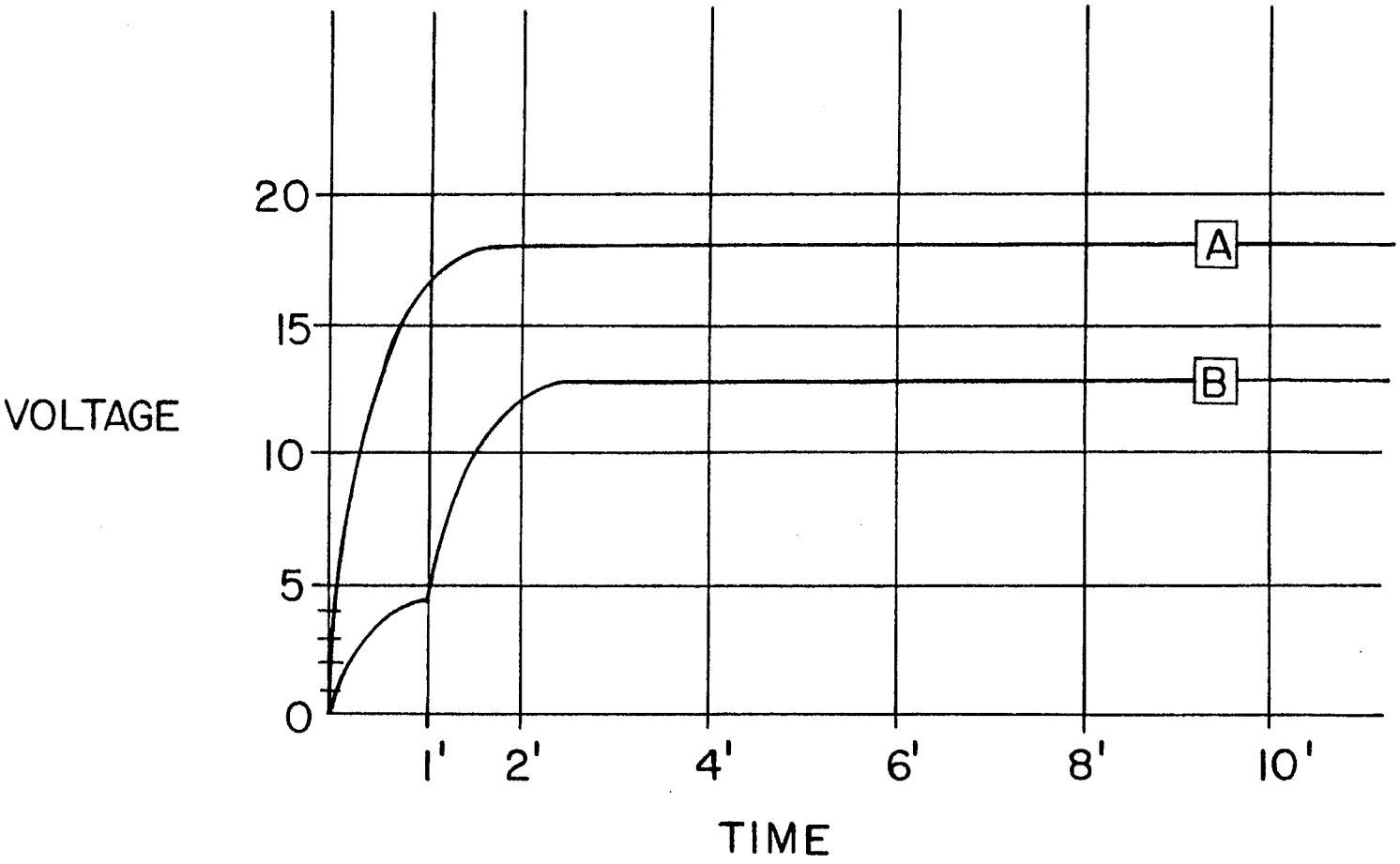
FIG. 11. Is a voltage/time diagram of an embodiment of the electrolytic coloration system.

Coloration phase: The anodized element underwent electrolytic coloration in a bath comprising:

| | |
|---|---|
| $SO_4Ni.7H_2O$ | 35 g/l |
| $SO_4Sn$ | 10 g/l |
| O-phenol sulphonic acid | 2 g/l |
| $SO_4H_2$ | 15 g/l |

and an asymmetric alternating voltage as shown in FIG. 11 was applied. Such figure shows the voltage variations of half-cycles A and B separately.

The following colours were obtained in the following times:

| | |
|---|---|
| Light Bronze | 1' |
| Medium Bronze | 2' |
| Dark Bronze | 3' |
| Black Bronze | 10' |

Example 2

Grey electrolytic coloration.

Anodizing phase: The element to be treated was previously anodized in a bath comprising:

| | |
|---|---|
| $SO_4H_2$ | 180 g/l |
| Glycerine | 3 g/l |
| Oxalic acid | 5 g/l |
| Ethylene glycol | 1 g/l |

under the following conditions:

| | |
|---|---|
| current density | 1.7 A/dm$^2$ |

-continued

| | |
|---|---|
| temperature | 20° C. |
| time | 40 minutes |

Opacifying phase: The anodized element was treated in a bath comprising:

| | |
|---|---|
| $SO_4H_2$ | 150 g/l |
| Oxalic acid | 20 g/l |
| Glycerine | 3 g/l |
| $Al^{3+}$ | 25 g/l |

at a temperature of 20° C.

Figure 12:
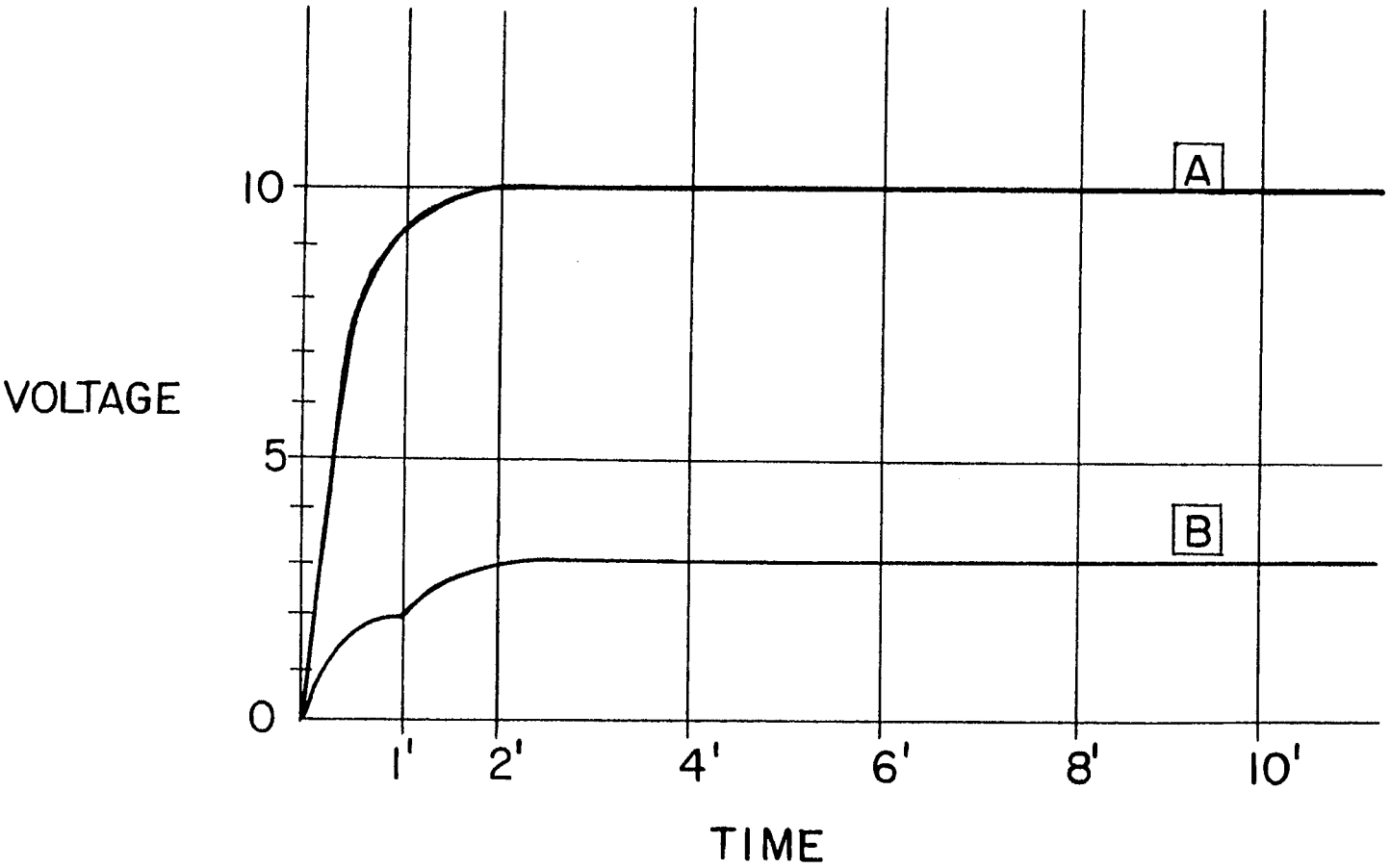
FIG. 12. Is a voltage/time diagram of an embodiment of the opacification system.

A symmetric alternating voltage as shown in FIG. 12 was applied. Such figure shows the voltage variations of half-cycles A and B separately.

After ten minutes a uniform opaque-whitish film was obtained.

Figure 13:
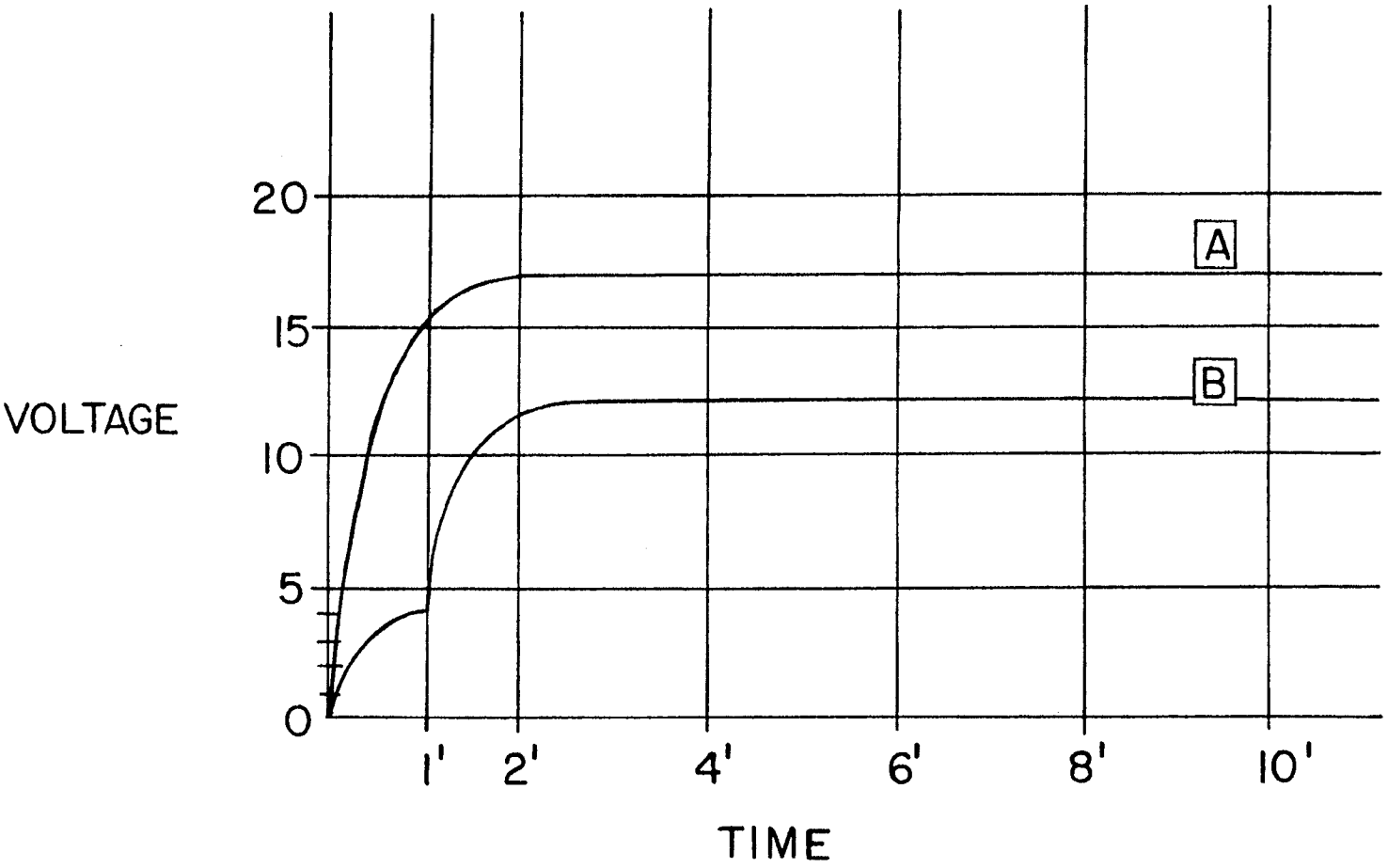
FIG. 13. Is the same diagram as in FIGS. 11 and 12, but for grey electrolytic coloration.

Coloration phase: The opacified element underwent electrolytic coloration in a bath comprising:

| | |
|---|---|
| $SO_4Ni.7H_2O$ | 35 g/l |
| $SO_4Sn$ | 10 g/l |
| O-phenol sulphonic acid | 2 g/l |
| $SO_4H_2$ | 15 g/l |

and a symmetric alternating voltage as in FIG. 13 was applied. Such figure shows the voltage variations of half-cycles A and B separately. The following colours were obtained in the following times:

| | |
|---|---|
| Light Grey | 30" |
| Medium Grey | 1' |
| Dark Grey | 2' |
| Black Grey | 5' |

Example 3

Blue optical interference coloration.

Anodizing phase: The element to be treated was previously anodized in a bath comprising:

| | |
|---|---|
| $SO_4H_2$ | 180 g/l |
| Glycerine | 3 g/l |
| Oxalic acid | 5 g/l |
| Ethylene glycol | 1 g/l |

under the following conditions:

| | |
|---|---|
| current density | 1.7 A/dm$^2$ |
| temperature | 20° C. |
| time | 40 minutes |

Precoloration phase: The anodized element was treated in a bath comprising:

| | |
|---|---|
| $SO_4H_2$ | 150 g/l |
| Oxalic acid | 20 g/l |
| Glycerine | 3 g/l |
| $Al^{3+}$ | 25 g/l |

at a temperature of 20° C.

Figure 14:
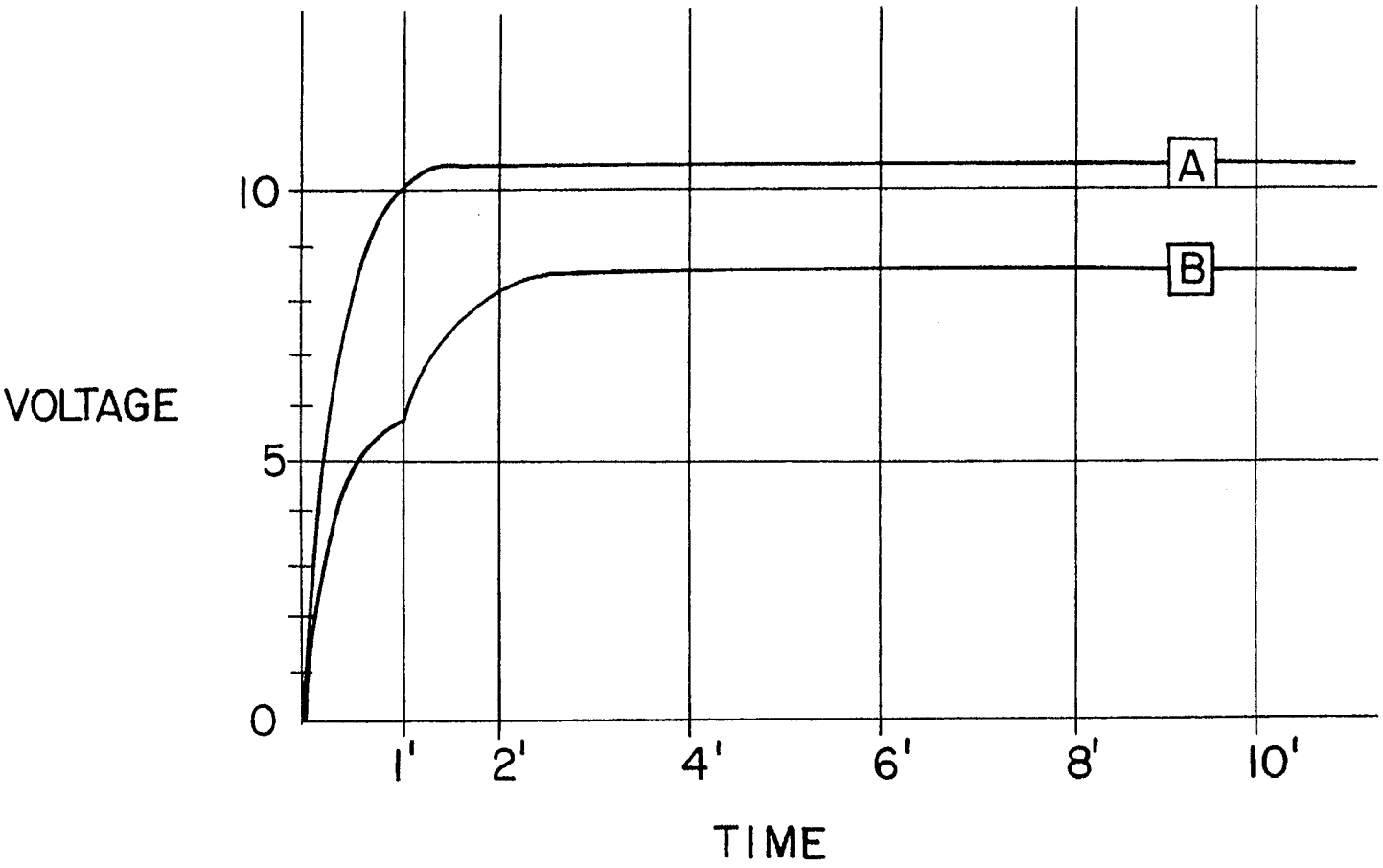
FIG. 14. Is the same diagram as in FIGS. 1 through 13, but for an optical interference pre-coloration phase.

An asymmetric alternating voltage as shown in FIG. 14 was applied. Such figure shows the voltage variations of half-cycles A and B separately.

After six minutes the process was stopped.

Coloration phase: The element, after having gone through the precoloration treatment, underwent coloration in a bath comprising:

| | |
|---|---|
| $SO_4Ni.7H_2O$ | 35 g/l |
| $SO_4(NH_4)_2$ | 20 g/l |
| $BO_3H_3$ | 30 g/l |
| $SO_4Mg$ | 5 g/l |
| $SO_4H_2$ | up to pH 4.2–4.7 |

Figure 15:
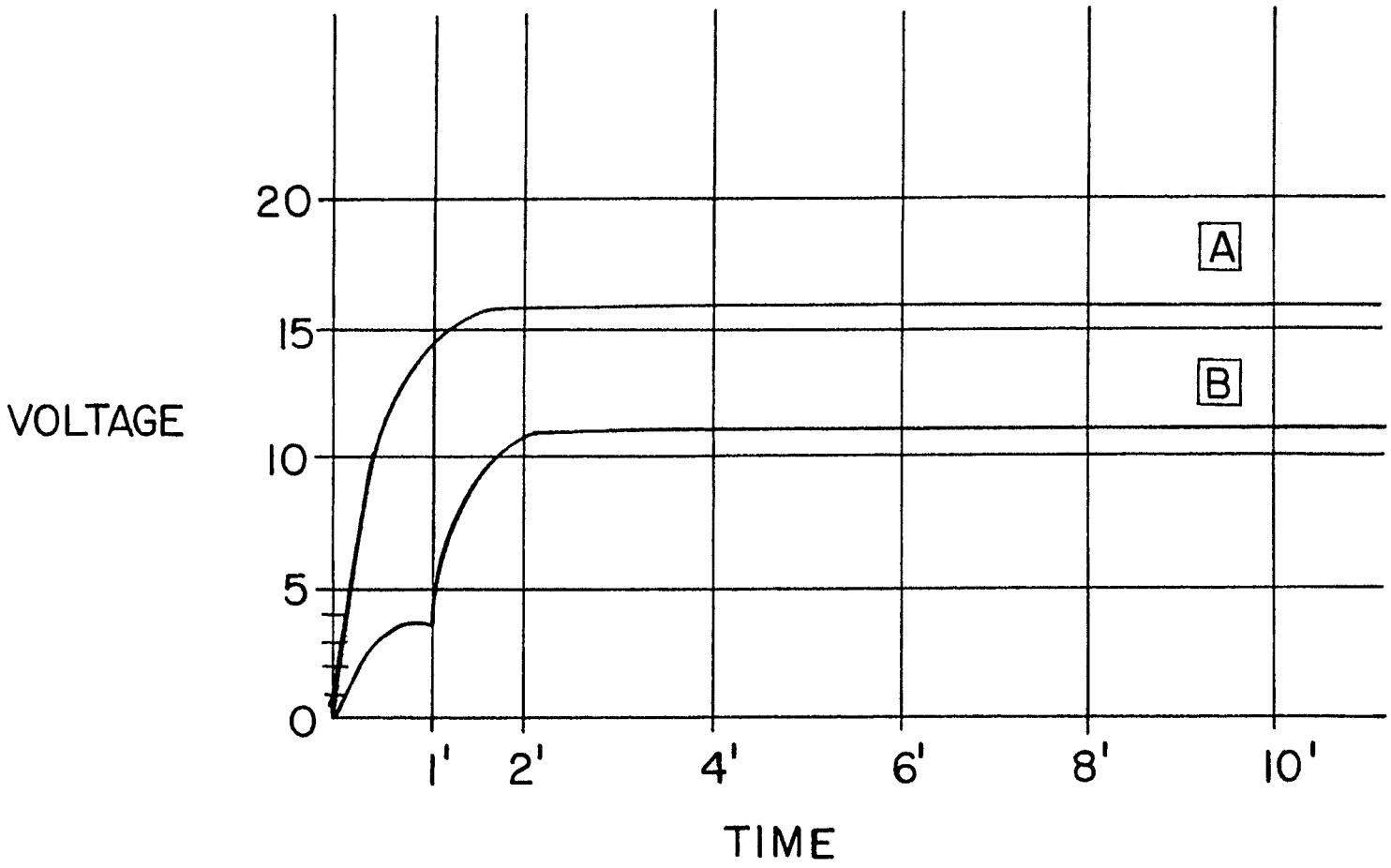
FIG. 15. Is, finally, another voltage/time diagram, in this case for blue coloration.

An asymmetric alternating voltage as in FIG. 15 was applied. Such figure shows the voltage variations of half-cycles A and B separately.

After two minutes of this treatment, a deep blue colour was obtained.

We feel that the device has now been sufficiently described for any expert in the art to have grasped the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. A current generation and control system for electrolytic processes in an electrolytic vat having a load and a counterload therein, the system comprising two autotransformers each having a primary part and a secondary part and being shunted to the same phase; each autotransformer including an automatically driven regulator coupled to said primary part thereof for automatically controlling the number of coils being operative at all times, said electrolytic vat having two inputs of which one input is coupled to said load and another input is coupled to said counterload, the secondary part of one of said autotransformers being coupled to said one input and the secondary part of another of said autotransformers being coupled to said another input; two half-wave rectifiers each coupled between the respective input of the electrolytic vat and the secondary part of the respective autotransformer such that said rectifiers act on opposite half-waves so that while one rectifier suppresses a negative half-wave from a voltage generated by one autotransformer another rectifier suppresses a positive half-wave of the voltage generated by another autotransformer to yield a sine wave voltage with symmetric or asymmetric positive and negative half-waves at said inputs; and a microprocessor coupled to said regulators so as to control an output voltage of said autotransformers, and to said rectifiers so as to control said positive and negative half-waves separately, each rectifier including a thyristor.

2. The current generation and control system according to claim 1, wherein said microprocessor is further coupled to said inputs for detecting contingent drifts of the sine wave voltage in either direction for resetting said transformer accordingly and wherein thyristors of said rectifiers control output voltages of said autotransformers to avoid short circuit problems which may be caused by an overlap of half-waves in opposite directions due to possible phase shifts.

* * * * *